US005547411A

United States Patent [19]

Lee

[11] Patent Number: 5,547,411

[45] Date of Patent: Aug. 20, 1996

[54] METHOD OF MANUFACTURING COLOR CATHODE RAY TUBE SCREEN

[75] Inventor: Byeong-yong Lee, Seoul, Rep. of Korea

[73] Assignee: Samsung Display Devices Co., Ltd., Kyungki-do, Rep. of Korea

[21] Appl. No.: 454,743

[22] Filed: May 31, 1995

Related U.S. Application Data

[62] Division of Ser. No. 125,216, Sep. 23, 1993, Pat. No. 5,489,816.

[30] Foreign Application Priority Data

Dec. 16, 1992 [KR] Rep. of Korea ..... 92-24471

[51] Int. Cl.[6] ..... H01J 9/227

[52] U.S. Cl. ..... 445/52; 427/68

[58] Field of Search ..... 445/52; 427/68

[56] References Cited

U.S. PATENT DOCUMENTS 5,326,588 7/1994 Ji ..... 427/68

5,372,903 12/1994 Tateyama et al. ..... 427/68 X

*Primary Examiner*—Kenneth J. Ramsey

*Attorney, Agent, or Firm*—Leydig, Voit & Mayer

[57] ABSTRACT

A color cathode ray tube having an improved screen and manufacturing method thereof including a black matrix and a phosphor layer formed on the inner surface of a panel and a metal back covering the tops of the black matrix and the phosphor layer. The metal back is in direct contact with the black matrix and is spaced from the phosphor layer. In the manufacturing method, a film overlapping the black matrix layer is partially removed so as to leave the film above the phosphor layer. This allows the metal back to be applied directly to the black matrix layer and thereby prevents the desquamation of the metal back.

2 Claims, 4 Drawing Sheets

METHOD OF MANUFACTURING COLOR CATHODE RAY TUBE SCREEN

This disclosure is a division of patent application Ser. No. 08/125,216, filed Sep. 23, 193, now U.S. Pat. No. 5,489,816.

BACKGROUND OF THE INVENTION

The present invention relates to a color cathode ray tube having an improved screen and a manufacturing method thereof, and more particularly to a color cathode ray tube and a manufacturing method thereof which effectively prevents a metal back, an element of the screen, from desquamating.

FIG. 1 is a sectional view of the conventional CRT. Generally, as shown in FIG. 1, a color cathode ray tube comprises a panel 10 on whose inner wall a screen 11 is formed so as to have a shadow mask 50 installed in front of screen 11, a funnel 20 bonded with panel 10 to form a vacuum bulb, an electron gun 30 installed inside a neck 21 provided at the rear end of the funnel, and a deflection yoke 40 installed on the outside of neck 21. In order to reproduce an image, electron beams emitted from the electron gun are deflected to land on precise locations on the phosphor screen by the deflection yoke, thus forming a pixel, a plurality of which complete a picture. Here, optimal pictures need the elements constituting a CRT to be in their best condition. Particularly, the formation of the phosphor screen on which an image is formed is a critical factor in obtaining a good-quality picture.

FIGS. 2 and 3 are enlarged views of a portion A of the conventional CRT of FIG. 1. Referring to FIG. 2, screen 11 formed on the inner surface of panel 10 is composed of a black matrix 12, a phosphor layer 13, a film 16 and a metal back 14. Also, black matrix 12 and phosphor layer 13 are formed directly on the surface of panel 10, film 16 covers the whole surface of black matrix 12 and phosphor layer 13, and metal back 14 covers film 16.

FIG. 3 shows a sectional view of the conventional CRT after heat-processing the panel. During heat-processing the panel, film 16 is vaporized and decomposed and escapes through metal back 14. Film 16 is an organic decomposable thin film and is comprised of a synthetic resin containing acryl emulsion. As shown in FIG.3, narrow gaps 10' are formed in the space between metal back 14 and the surface of black matrix 12 and phosphor layer 13, the space having been occupied by film 16. Also, metal back 14, which has a thickness of nearly ten microns, becomes partially rugged and makes contact with black matrix 12 and phosphor layer 13. Here, the metal back layer is for reflecting all of the light generated in the screen 11 to the panel 10 of the CRT.

FIG. 4 shows a process of manufacturing a conventional screen having the above structure, which will be described below.

(a) Black matrix forming step: A liquid graphite solution containing positive photoresist is coated over the entire panel and then exposed to ultraviolet light through the shadow mask holes, to harden in precise locations in the form of dots or lines. After the exposure, the unhardened portion of the photoresist film is washed away, and then the remainder is dried. The graphite which remains is in contact with the panel and has a striped pattern or dotted pattern, that is, a black matrix.

(b) Phosphor layer forming step: Red, green and blue phosphors are formed on the bottom of the panel, for example, in a striped pattern or a dot-trio pattern. In this step, R, G and B phosphor slurry is used and ordinary photolithography is used, which comprises an exposing step using a pattern mask and a developing step in which the exposed portion is selectively etched.

(c) Film forming step: A filming liquid of a synthetic resin containing acryl emulsion in a predetermined thickness coats the surface of the phosphor layer and the black matrix formed in a predetermined pattern, and is dried to form a film 16. The film 16 planarizes the rough phosphor layer 13, and prevents the penetration of aluminum into the phosphor screen in a subsequent process. This functions to even the surface of the phosphor layer 13 having non-uniform particles and to bury exposed cavities of the phosphor layer 13 so as to improve the planarization of a metal back 14 produced in a later-mentioned step. This step includes applying the filming liquid to the panel and drying it so as to have a specific hardness.

(d) Metal film forming step: A metal film is formed on the overall phosphor layer 13 in which the film 16 is formed. The metal film is generally made of aluminum, and called a metal back 14. The metal back 14 is formed by an evaporation method using a vacuum chamber.

(e) Baking step: After the above steps, the panel is heated to pyrolyze and eliminate the film 16 interposed between the phosphor layer and the metal film back 14. Here, the heating temperature is about 400° C.

Through the above steps, the screen is completed on the inner surface of the panel. Since the film 16 is eliminated by pyrolysis, gaps are produced under the metal back 14. The metal back 14 is partially in contact with the phosphor layer 13 and black matrix 12 and the whole exposed surface is uniform.

The conventional manufacturing process has the following problems.

Since the film 16 has to coat the whole surface of the black matrix and phosphor layer 13 including the panel periphery and skirt, using a slurry coating or spray coating method while the glass panel 10 and top of the graphite 12 are very slippery, the skirt and periphery have a greater tendency for desquamation or blistering. The graphite particles are much smaller than the phosphor particles used for the screen. The film 16 becomes swollen or desquamated during the bake-out process after the formation of the metal back 14, since a great deal of gas is locally generated due to pyrolysis. Such desquamation takes place frequently at the corners of the panel around the screen where a great deal of gas is generated, as well as in the image display portion of the screen. The desquamation also occurs frequently due to vibration during a dust cleaning process after the completion of the screen and before the completion of the CRT.

The desquamation of the metal back 14 may happen even in the finished product because the metal back 14 is weakly adhered to the black matrix 12 and the phosphor layer 13. That is, since the film 16 under the overall surface of the metal back 14 is substantially separated from the phosphor layer 13 and the black 14 matrix 12, the metal back is subject to desquamation even due to slight vibrations or impacts. As a result, the problem deteriorates the quality of the whole screen including the phosphor layer 13 and impedes realization of a good-quality picture. Further, the pieces of the desquamated metal back 14 stick to the shadow mask, closing the beam passing holes and rendering the product useless.

SUMMARY OF THE INVENTION

Therefore, it is an object of the present invention to provide a color cathode ray tube having an improved screen and the manufacturing method thereof which is capable of effectively preventing a metal back from desquamating.

In order to accomplish the object, there is provided a color cathode ray tube having an improved screen comprising: a panel inside which a shadow mask is installed; a screen having a black matrix and a phosphor layer formed on the inner surface of the panel in a predetermined pattern and a metal back coveting the top of the black matrix and the phosphor layer; a shadow mask installed in front of the screen; a funnel coupled to the panel to form a vacuum tube; an electron gun incorporated into the neck at the end portion of the funnel; and a deflection yoke installed around the neck, wherein the metal back is in direct contact with the black matrix and is spaced from the phosphor layer by a certain distance, so as to provide gaps between the metal back and the phosphor layer.

In order to accomplish the object, there is provided a manufacturing method of a color cathode ray tube having an improved screen comprising the steps of: forming a black matrix on the inner surface of a panel in a predetermined pattern; forming a red, green and blue phosphor layer on the bottom of the panel between the black matrix; forming a film of a specific thickness above the phosphor layer and the black matrix; partially removing the film overlapping the black matrix so that the film remains only above the phosphor layer; overlaying a metal film on the film and on the black matrix exposed between the film; heat-processing the panel after the steps to pyrolyze the film remaining above the phosphor layer; installing a shadow mask assembly on the inside of the panel; and coupling a funnel having an electron gun in the neck to the panel.

In the manufacturing method for the color cathode ray tube of the present invention, the film remaining above the phosphor layer is left and the film above the black matrix is removed. In the case of the phosphor layer being striped, the film is also striped corresponding to the black matrix.

BRIEF DESCRIPTION OF THE DRAWINGS

The above object and other advantages of the present invention will become more apparent by describing in detail a preferred embodiment thereof with reference to the attached drawings in which.

DETAILED DESCRIPTION OF THE INVENTION

Figure 1:
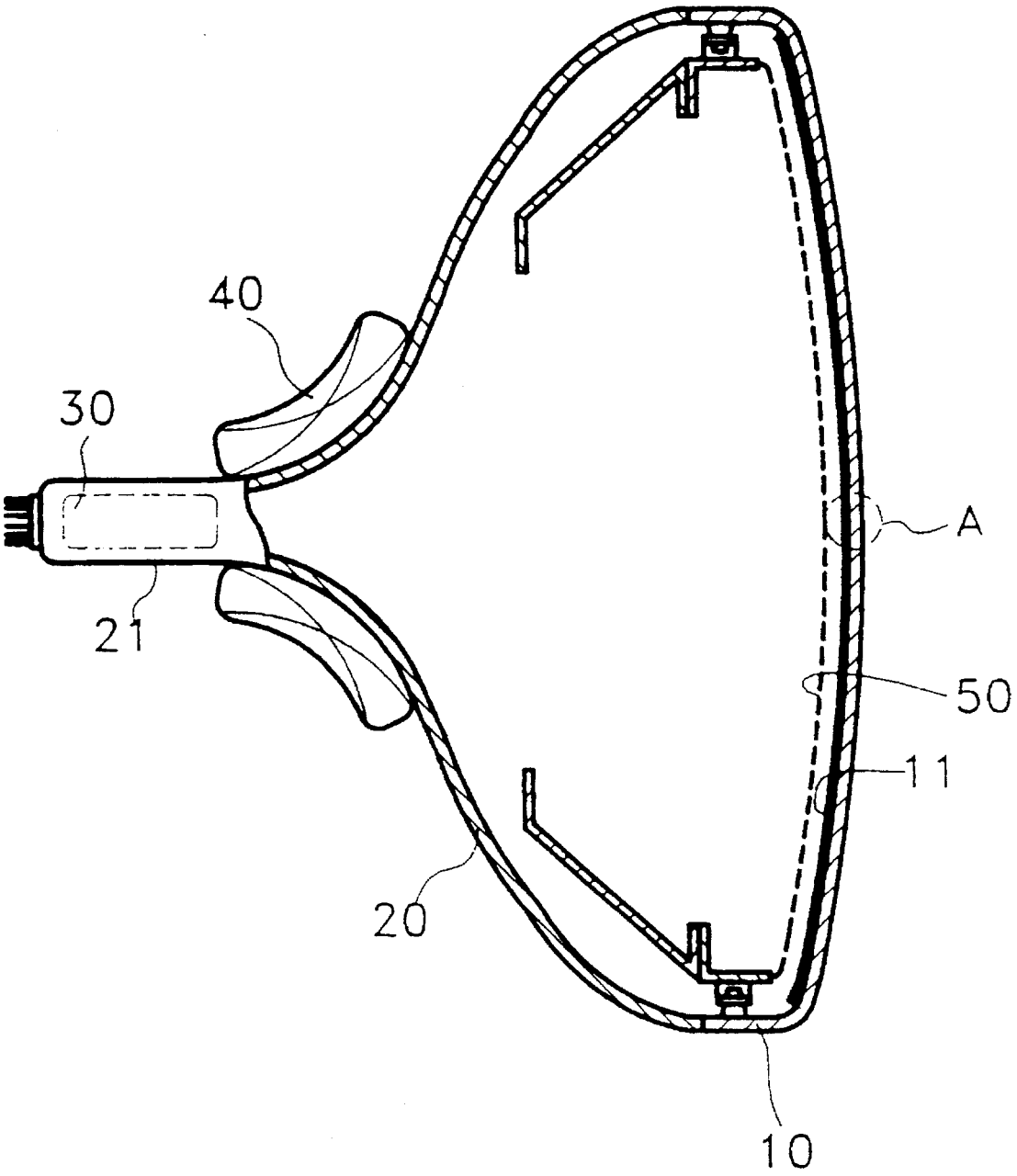
FIG. 1 is a cross-sectional view of a color cathode ray tube.
Figure 2:
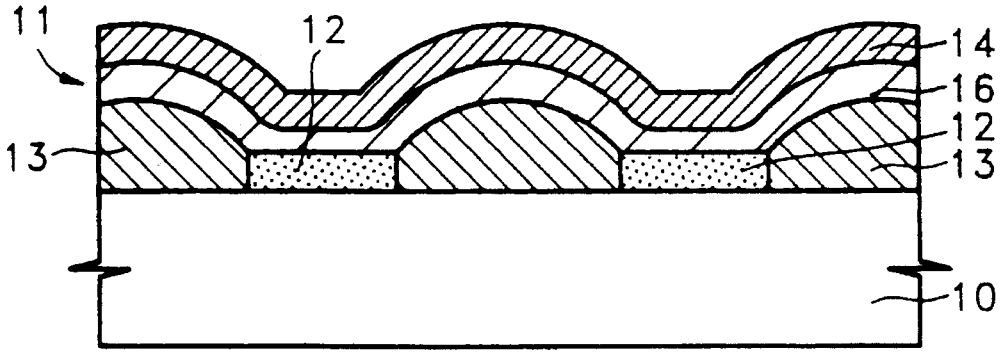
FIG. 2 (PRIOR ART)
FIGS. 2 and 3 are partial cross-sectional views of a conventional screen for a CRT manufactured by a conventional manufacturing method.
Figure 3:
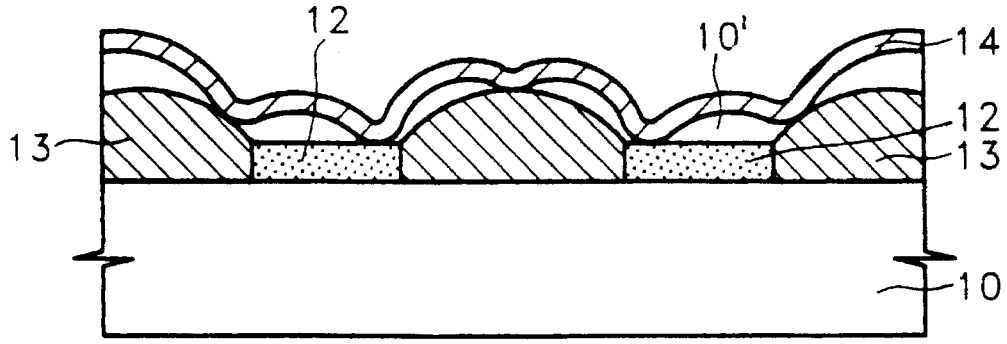
FIG. 3 (PRIOR ART)
Figure 4:
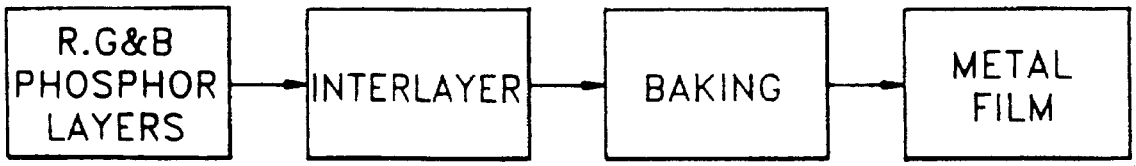
FIG. 4 (PRIOR ART)
FIG. 4 is a block diagram of a process of forming a phosphor screen for the conventional color CRT.

A color CRT according to the present invention, as in FIG. 1, comprises a panel 16 on whose inner surface a screen 11 is formed, a shadow mask installed at the panel so as to oppose the screen in the interior of the panel, a funnel which is coupled to the panel to form a vacuum enclosure, an electron gun 36 and a deflection yoke 40 which are installed on the inner and outer sides of the neck 21 provided in that end portion of the funnel. The color CRT according to present invention comprises an improved screen 110, as shown in FIG. 5.

Figure 5:
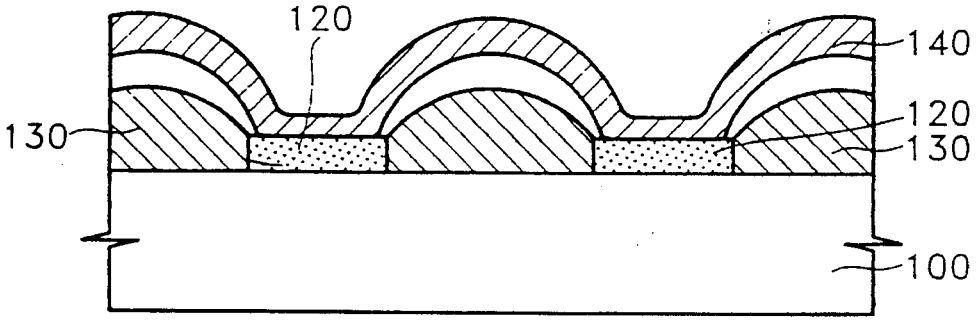
FIG. 5 is an partial cross-sectional view of a CRT according to the present invention.
Figure 6:
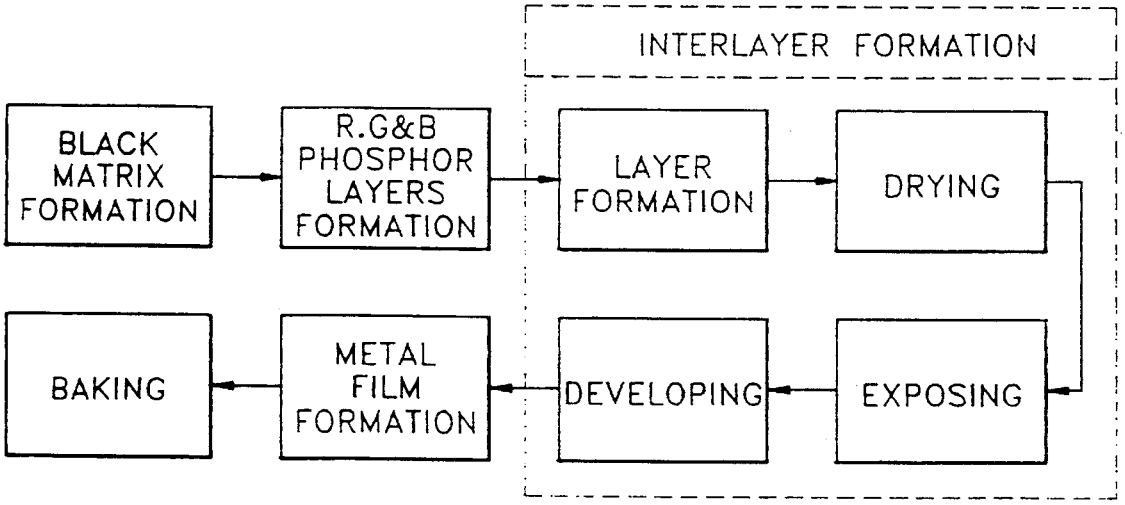
FIG. 6 is a block diagram of a process of forming a phosphor screen for a CRT according to the present invention.

FIG. 5 is an enlarged cross-sectional view of screen 110 of a color CRT according to the present invention. Black matrix 120 and phosphor layer 130 alternate on the inner bottom of panel 100. Metal back 140 is formed thereon. Portions of metal back 140 come into contact with black matrix 120, while other portions thereof are separated from phosphor layer 130 by gaps of a specific width between the metal back 140 and the phosphor layer 130.

The metal back 140 has channel-type grooves at contact points with the black matrix 120 when the black matrix 120 is a stripe type. When the phosphor layer is a dot type, the portions corresponding to the phosphor layer (the gaps) are cylindrical protrusions.

In the metal back of the present invention, contrary to the conventional metal back, the overall portions corresponding to the black matrix adhere to the black matrix directly. Due to the intensified adhesion of the metal back, the metal back scarcely desquamates from the plane formed by the phosphor layer and the black matrix.

A manufacturing method according to the present invention comprises the following steps:

(a) forming the black matrix on the inner surface of the panel in a predetermined pattern;

(b) forming a red, green and blue phosphor layer on the inner surface of the panel between elements of the black matrix;

(c) forming a film of a specific thickness on the phosphor layer and the black matrix and partially removing the film overlapping the black matrix so that the film remains only opposite the phosphor layer;

(d) overlaying a metal film on the film and on the black matrix exposed between the film;

(e) baking the panel after the above steps to pyrolyze the film remaining above the phosphor layer;

Among the above steps, all but step (c) for forming the film, follow the conventional method. Specifically, after step (e) for baking, there are subsequent steps for installing a shadow mask assembly inside the panel and coupling the funnel to the panel, as in the conventional method.

A method according to the present invention will be described below more specifically.

Figure 7:
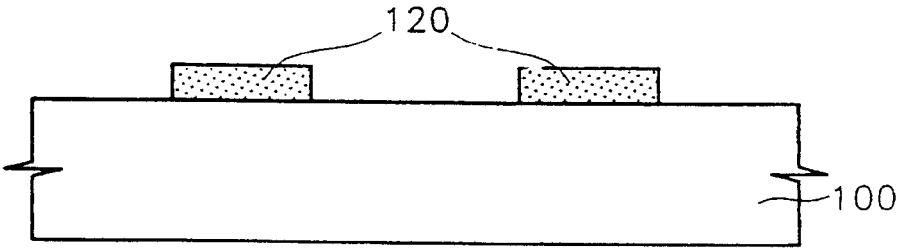
FIGS. 7–11 illustrate the sequence of manufacturing a screen according to the present invention.

Step (a): As shown in FIG. 7 and in the usual process, first, a coating of a photosensitive resin containing PVA is applied to the interior of panel 100 to form a resin layer. The resin layer is exposed in a predetermined pattern using a shadow mask and is coated with graphite and is developed with water, so as to produce black matrix 120 in a predetermined pattern, for instance, a stripe pattern. The exposure is performed with an exposure device using a shadow mask.

Figure 8:
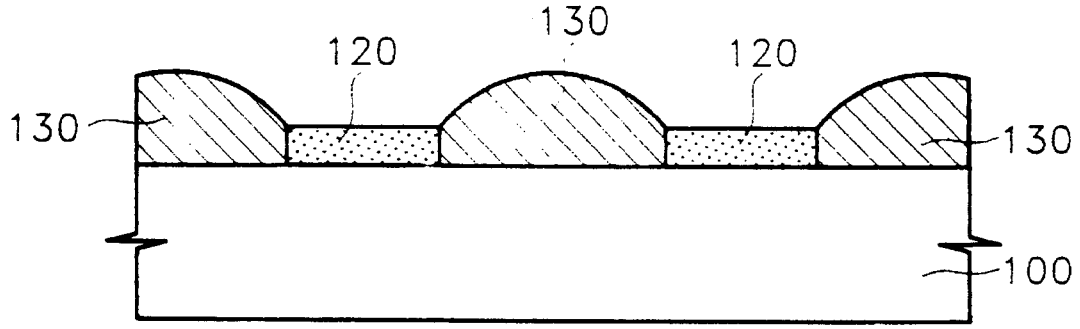

Step (b): As shown in FIG. 8, the red, green and blue phosphors 130 alternate with elements of the black matrix 120. The phosphor layer 130 formation step includes a step of coating phosphor slurry on the inner surface of the panel, a step of exposing the coated phosphor layer into a predetermined pattern using the shadow mask, and a developing step of etching the exposed phosphor layer 130 to leave only the striped phosphor layer on an intended portion. The sequential steps are carried out three times with respect to R, G and B phosphor slurries.

Figure 9:
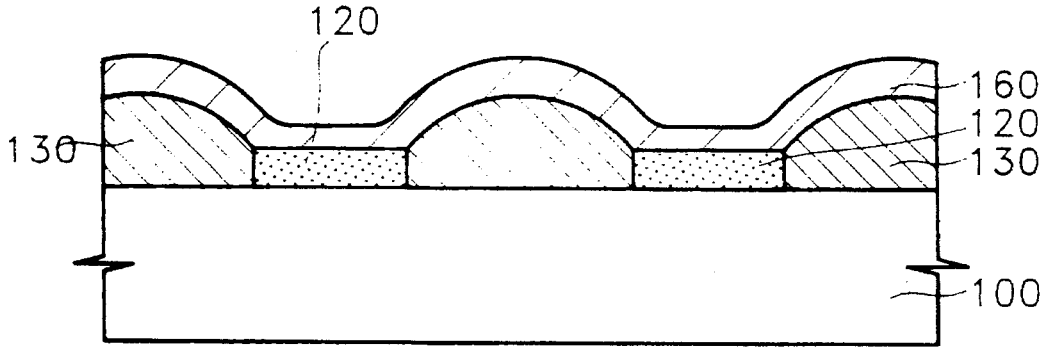
Figure 10:
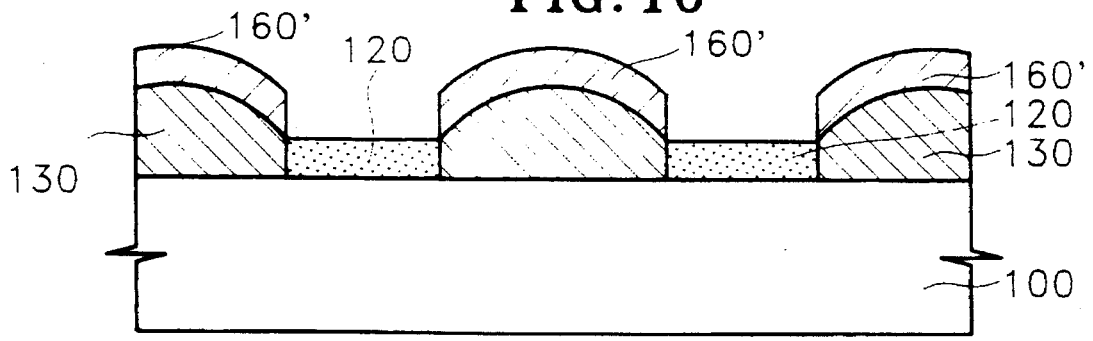

Step (c): As shown in FIG. 9, a coating of a high molecular weight liquid containing a photosensitive material such as PVA is applied to the entire surface of the phosphor layer 130 to form film 160 and is exposed as in the forming steps of black matrix 120 and phosphor layer 130, and, as shown in FIG. 10, the portion of the film 160 overlapping the black matrix is etched with an etching solution such as water or sodium hydroxide (SHO), to form film pattern 160' in a predetermined pattern, for instance, a stripe pattern.

Figure 11:
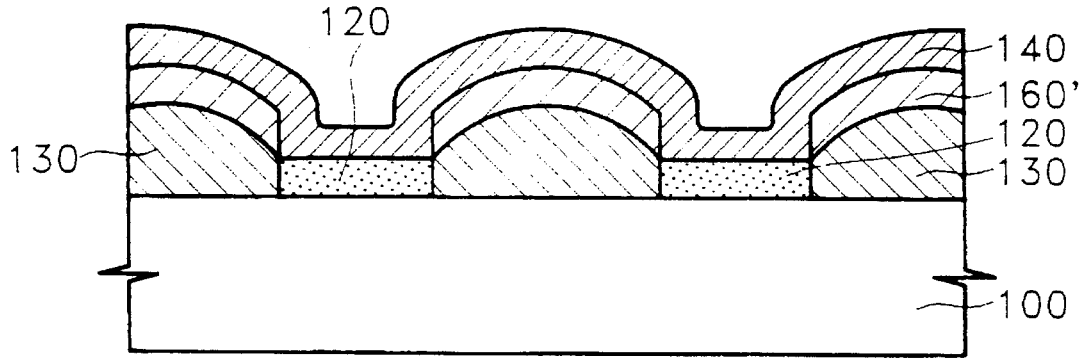

Step (d): As shown in FIG. 11, metal back 140 is formed on film pattern 160' and black matrix 120 exposed therebetween. Here, usually, aluminum is used as the metal, and evaporation is carried out using a vacuum chamber.

Step (e): After the steps, the panel is heated at about 400° C. to pyrolyze the overall high molecular weight material layer on the panel. By doing this, as shown in FIG. 5, the screen is formed on the inner bottom of panel 100.

Among the steps of forming the phosphor layer of the present invention is the step of forming the film.

The filming liquid is applied over the entire inner surface of the panel on which the black matrix and the phosphor layer are formed, to form a resin layer which is dried through a drying step. It is desirable that as the film material, a mixture of polyvinyl alcohol (PVA) and ammonium dichromate (ADC) or a mixture of polyvinyl pyrrolidone (PVP) and ADC is used. After the layer is dried, it is exposed to ultraviolet light so that only the film on top of the phosphor layer in the predetermined pattern is exposed and hardened and the film on the black matrix positioned between the phosphor layer and the periphery of the screen is not exposed. The exposed film is developed i.e., removed leaving opposite the only the film located of phosphor layer and the remainder is removed, especially the part of the film located on the skirt of the panel and adhered to the corners which adjoin the skirt.

Since, in the method of manufacturing a phosphor screen for a color CRT according to the present invention, the film on the phosphor layer on the inner stirface of the panel is only over the phosphor layer and not on the black matrix, the amount of organic gas generated during the baking of the film is remarkably reduced, as compared with the conventional method. Further, since the film concentrated on the edges and corners of the panel is removed before the baking, the desquamation of the metal back at the periphery on the screen of the panel during baking is prevented.

Even after a completion of the color CRT according to the present invention, since the metal back is strongly adhered to the black matrix, impacts rarely desquamate the metal back. Experimentally, the color CRT made according to the present invention is improved by 20% in luminance, compared with the conventional color CRT.

As described above, a method of forming the phosphor screen for the color CRT according to the present invention prevents the dilatation of the metal back during the baking of the panel. Therefore, the proportion of defective products is greatly reduced, improving productivity.

What is claimed is:

1. A method of manufacturing a color cathode ray tube having an improved screen comprising the steps of:

forming a black matrix on an inner surface of a panel;

forming a red, green and blue phosphor layer on the panel between elements of said black matrix;

forming a first film of a specific thickness on said phosphor layer and said black matrix;

removing said first film from said black matrix so that said first film remains on said phosphor layer;

overlaying a metal film on said first film and on said black matrix;

heat-processing the panel to pyrolyze said first film;

installing a shadow mask assembly on the panel; and coupling a funnel having a neck and an electron gun in the neck to the panel.

2. A method of manufacturing a color cathode ray tube comprising:

forming a black matrix on an inner surface of a panel, said black matrix having a plurality of openings;

forming phosphor elements, on the panel in the openings of said black matrix;

forming a first film on said phosphor elements and said black matrix;

removing said first film from said black matrix so that parts of said first film remain on said phosphor elements;

overlaying a metal film on the parts of said first film and on said black matrix; and pyrolyzing the parts of said first film.

* * * * *

UNITED STATES PATENT AND TRADEMARK OFFICE

CERTIFICATE OF CORRECTION

PATENT NO. : 5,547,411

DATED : August 20, 1996

INVENTOR(S) : Lee

It is certified that error appears in the above-indentified patent and that said Letters Patent is hereby corrected as shown below:

Column 6, Line 13, delete --claim 1 (Lines 13-27)--;

Line 28, change "2" to --1--;

Line 32, after "elements" delete --,--;

Line 42, insert the following:

-- 2. The manufacturing method as claimed in claim 1, wherein removing said first film from said black matrix includes removing said first film from a skirt of the panel.--.

Signed and Sealed this

Fourth Day of March, 1997

Bruce Lehman

*Attest:*

BRUCE LEHMAN

*Attesting Officer*

*Commissioner of Patents and Trademarks*